US006254428B1

(12) United States Patent
Murakami et al.

(10) Patent No.: US 6,254,428 B1
(45) Date of Patent: Jul. 3, 2001

(54) WATERPROOF STRUCTURE FOR CONNECTOR

(75) Inventors: Takao Murakami; Naoto Taguchi, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/640,648

(22) Filed: Aug. 18, 2000

(30) Foreign Application Priority Data

Sep. 17, 1999 (JP) ..... 11-264528

(51) Int. Cl.[7] ..... H01R 13/73
(52) U.S. Cl. ..... 439/556; 439/588
(58) Field of Search ..... 439/587, 588, 439/553, 559, 548, 556

(56) References Cited

U.S. PATENT DOCUMENTS 3,611,256 * 10/1971 Abair ..... 439/559
4,705,339 * 11/1987 Hayes et al. ..... 439/277
5,249,982 * 10/1993 Funck et al. ..... 439/556
5,895,290 * 4/1999 Self, Jr. ..... 439/556
6,089,910 * 7/2000 Suzuki et al. ..... 439/559

FOREIGN PATENT DOCUMENTS 10-172643 6/1998 (JP) ..... H01R/13/52

* cited by examiner

*Primary Examiner*—Tulsidas Patel
(74) *Attorney, Agent, or Firm*—Sughrue, Mion, Zinn, Macpeak & Seas, PLLC

(57) ABSTRACT

A waterproof structure of a connector in which a first connector F is attached to a casing 60 via a first waterproof seal 48, and a second connector M is engaged with the first connector F via a second waterproof seal 47. The first waterproof seal 48 for sealing between the first connector 48 and the casing 60 and the second waterproof seal 47 for sealing between the second connector M and the first connector F are integrated with each other on a single waterproof sealer 40.

4 Claims, 4 Drawing Sheets

WATERPROOF STRUCTURE FOR CONNECTOR

BACKGROUND OF THE INVENTION

The present invention relates to a waterproof structure for a connector attached to a casing of provided with an electronic control unit and others.

FIG. 4 is a view showing a waterproof structure of a related connector disclosed in Japanese Patent Publication No. 10-172643A. As shown in FIG. 4A, in this waterproof structure of a connector, the first connector 1 is attached to the opening 4 of the box-shaped casing 3 via the first seal ring 5, and also as shown in FIG. 4B, the second connector 2 is engaged with the first connector 1 via the second seal ring 6. Due to the above structure, the necessary space is made waterproof.

However, the following problems may be encountered in the above related waterproof structure. The first seal ring 5 to seal between the casing 3 and the first connector 1 and the second seal ring 6 to seal between the first 1 and the second connector 2 are composed and provided as individual members. Therefore, especially when the first connector 1 has a large number of engaging sections to be engaged with the second connector, it necessary to provide a large number of second seal rings 6. Therefore, the number of parts is increased, and the manufacturing cost is raised.

SUMMARY OF THE INVENTION

The present invention has been accomplished in view of the above circumstances. It is an object of the present invention to provide a waterproof structure of a connector capable of reducing the manufacturing cost by decreasing the number of parts.

In order to achieve the above object, according to the present invention, there is provided a waterproof structure comprising:

- a casing body;
- a sealing member on which a first seal and a second seal are integrally formed;
- a first connector housing fitted with the casing body while interposing the first seal therebetween; and
- a second connector housing fitted with the first connector housing while interposing the second seal therebetween.

According to the above waterproof structure, since the first seal interposed between the first connector housing and the casing body and the second seal interposed between the first and second connector housings are integrally formed on a single sealing member, the number of parts can be decreased, and the manufacturing cost of the entire structure can be reduced.

Preferably, the first connector is provided with a plurality of chambers for respectively accommodating the second connector housing. The second seal is formed into a shape corresponding to the number of the second connector housings.

According to this waterproof structure, although the number of portions to be sealed is large, all sealing can be accomplished by a single sealing member. Therefore, the number of parts can be decreased.

Preferably, the sealing member is provided as an interposed member having a cover portion for covering the first connector housing and an opening into which the second connector is inserted. The first seal is formed on an end of the cover portion so as to be interposed between the first connector housing and the casing body. The second seal is formed on a periphery of the openings so as to be interposed between the first and second connector housings.

According to the above waterproof structure, manufacturing is easy. Further, it enough that the sealing member is attached to the first connector in such a manner that it covers the first connector, that is, attaching is easy.

Preferably, the sealing member is provided with a through hole into which a screw is inserted to secure the first connector housing to the casing body. The screw is provided with a flange portion for sealing the through hole.

According to the above waterproof structure, when the connector housing is attached to the casing body with a screw, the through hole is closed by the flange of the screw. Therefore, the reliability of seal can be enhanced in all the portions of the connector including the screw attaching section.

DETAILED DESCRIPTION OF THE PREFERRED EMBODIMENTS

Figure 1:
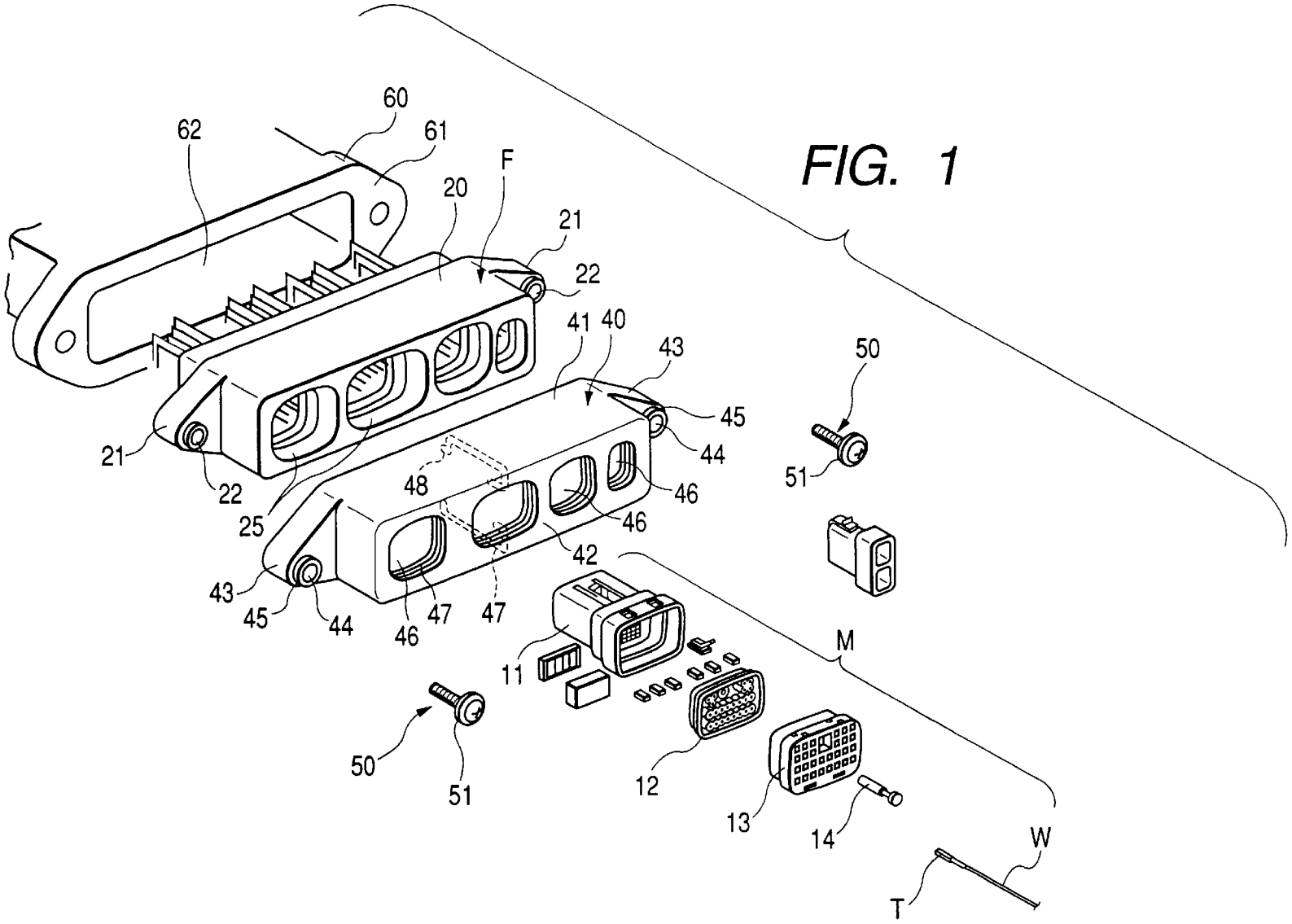
FIG. 1 is an exploded perspective view of a waterproof structure of a connector according to one embodiment of the present invention.

Referring to the drawings, an embodiment of the present invention will be explained as follows.

FIG. 1 is an exploded perspective view of a waterproof structure of a connector according to one an embodiment of the present invention.

In FIG. 1, reference numeral 60 denotes a casing made of synthetic resin such as a casing provided with an electronic control unit, reference symbol F denotes a female connector made of synthetic resin (first connector), reference symbol M denotes a male connector made of synthetic resin (second connector), reference numeral 40 denotes a waterproof sealer, and reference numeral 50 denotes a screw having a flange used for fixing the female connector F to the casing 60.

The casing 60 includes a chamber 62 for accommodating the female connector F and an end face 61 to which the female connector F is attached with a screw.

The female connector F includes a housing 20 in which a plurality of engaging sections 25 engaged with the male connector M are provided, and a pair of flanges 21 each having a through hole 22 into which the screw is inserted are arranged both sides of the housing 20.

The male connector M includes a housing 11 made of synthetic resin for accommodating a large number of terminals T, a mat-shaped waterproof plug 12 for sealing the periphery of electrical wire W extending backward from terminal T, a rear holder 13 made of synthetic resin, and a lock releaser 14 made of synthetic resin.

The waterproof sealer 40 is made of rubber or thermoplastic elastomer resin and formed into a shape of a cover which covers the connector housing 20 of the female connector F. The waterproof sealer 40 includes a peripheral wall 41 for covering a periphery of the female connector F, an end wall 42 for covering an end face of the female connector F, and flange cover sections 43 for covering the flanges 21 of the female connector F.

On the end wall 42 of the waterproof sealer 40, there are formed a plurality of openings 46 which correspond to the male connector engaging sections 25 of the female connector F. Through each opening 46, the male connector M is capable of engaging with the female connector F. In each flange cover section 43, there is provided a through hole 44 into which the screw 50 is inserted. In the periphery of each through hole 44, there is provided a seal ring 45 which rises annularly.

Figure 2:
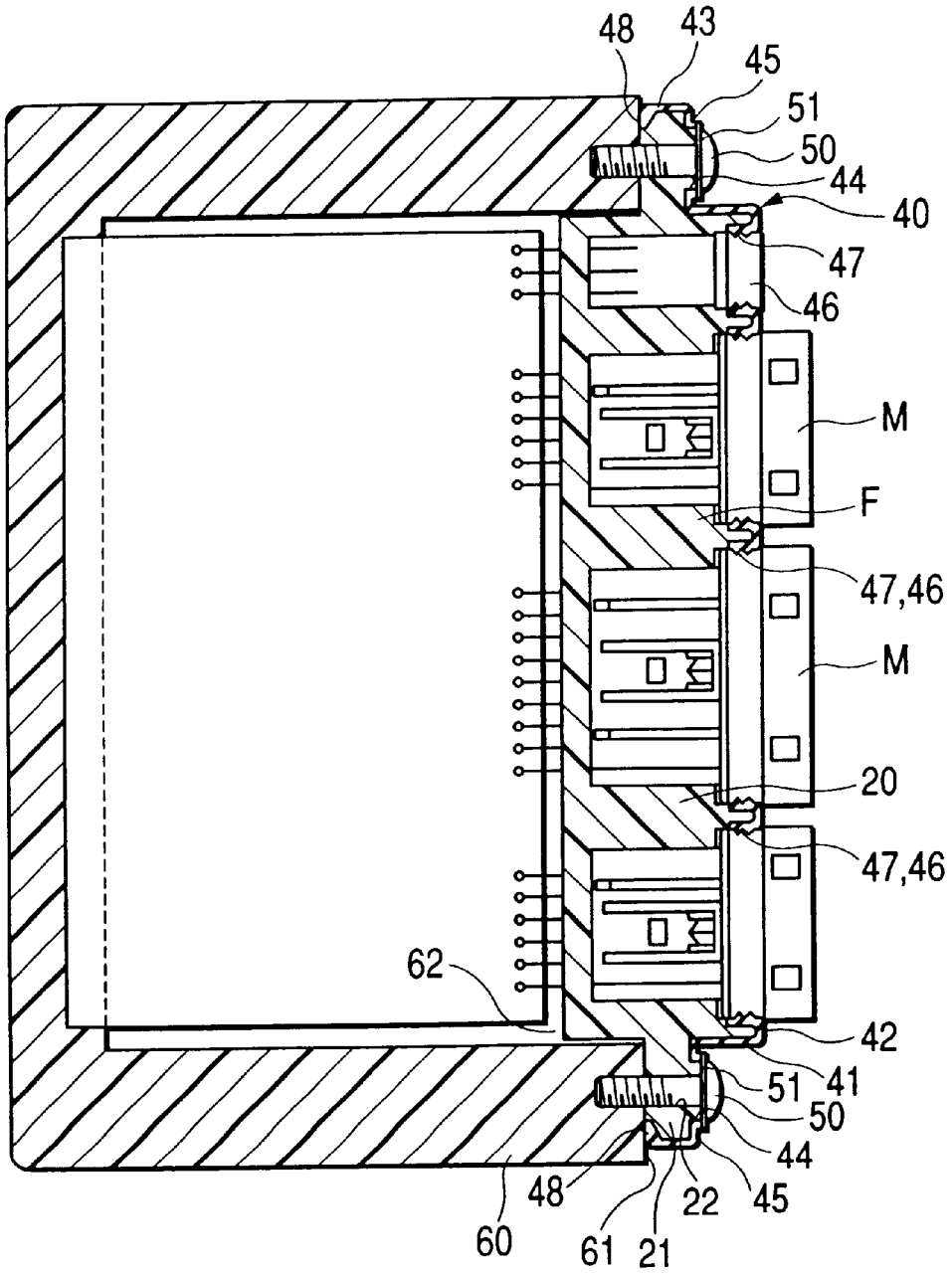
FIG. 2 is a horizontal cross-sectional view of the waterproof structure shown in FIG. 1.
Figure 3:
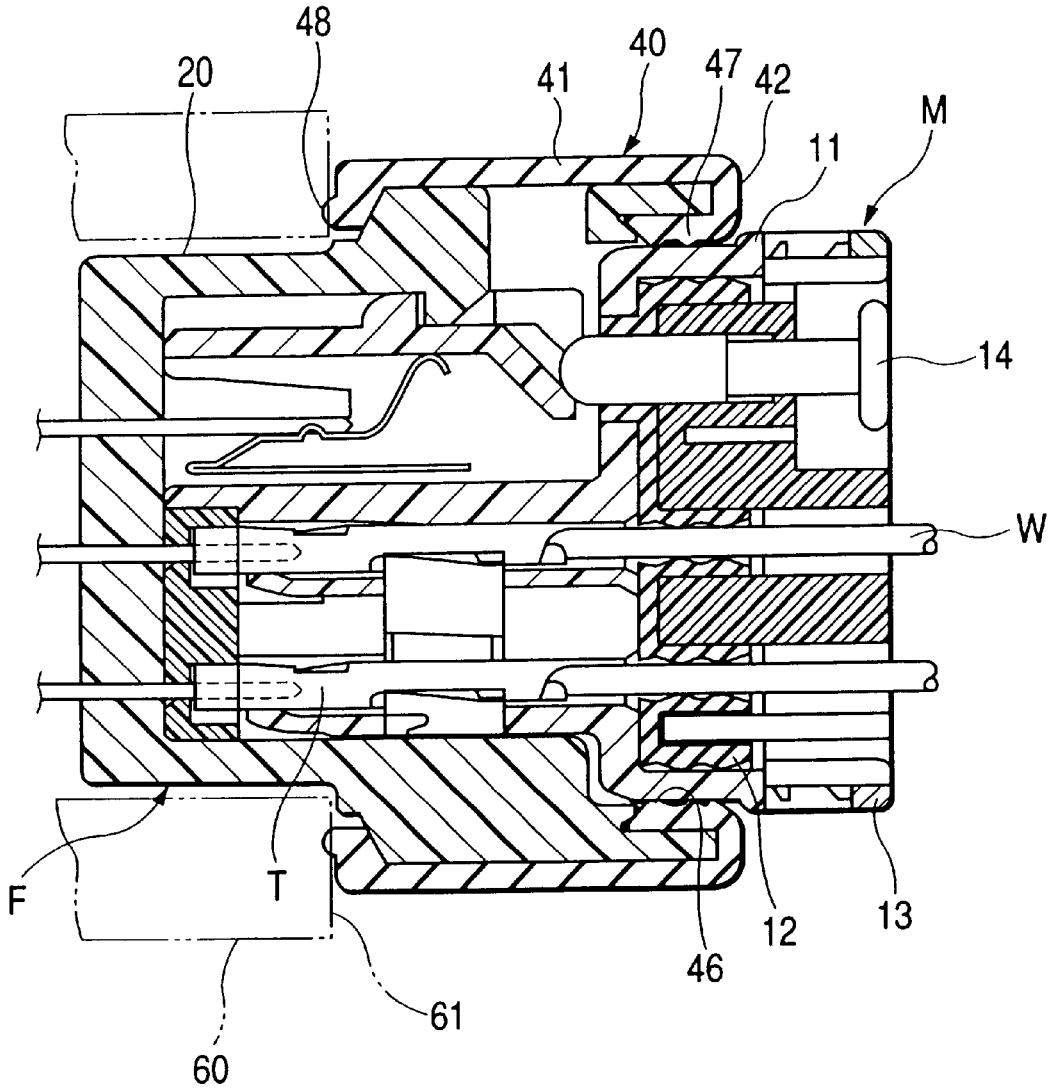
FIG. 3 is a vertical cross-sectional view of the waterproof structure shown in FIG. 1.
Figure 4A:
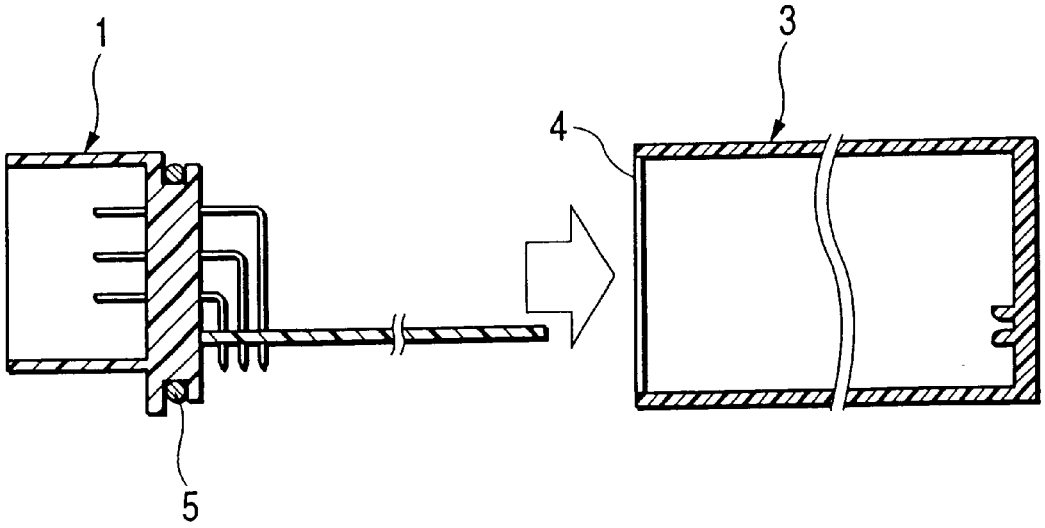
FIG. 4A PRIOR ART
FIG. 4A is a cross-sectional view of a related waterproof structure, showing a state in which the first connector is attached to a casing.
Figure 4B:
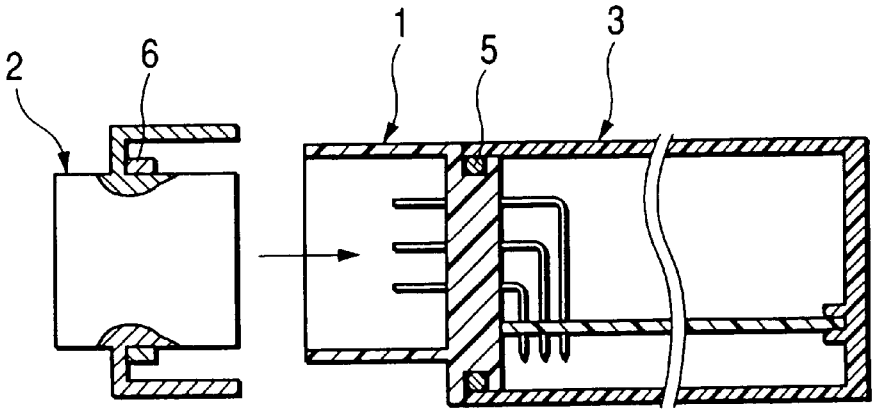
FIG. 4B PRIOR ART
FIG. 4B is a cross-sectional view of the related waterproof structure, showing a state in which the second connector is engaged with the first connector.

FIG. 2 is a view showing a cross section of a state in which the casing 60, the female connector F and the male connector M are sealingly connected with each other by the waterproof sealer 40. FIG. 3 is a view showing a crosssection of a state in which the male connector M and the female connector F are engaged with each other.

As shown in FIGS. 2 and 3, on the waterproof sealer 40, there are integrally provided a first waterproof seal 48 which is arranged at the end portion on the opposite side to the end wall 42 side of the peripheral wall 41 so as to extend to the rear of the connector housing 20 of the female connector F, and a second waterproof seal 47 arranged in the periphery of the opening 46 so as to surround the hood section of the female connector housing 20.

When the female connector F is attached to the casing 60, the first waterproof seal 48 is interposed between the end face 61 of the casing 60 and connector housing 20 of the female connector F. Due to the foregoing, the first waterproof seal 48 seals a gap formed between the casing 60 and the female connector F. The second waterproof seal 47 seals a gap formed between both connector housings 20, 11 when the male connector M is engaged with the female connector F.

This waterproof structure can be realized as follows. First, the waterproof sealer 40 covers the front side of the female connector F, so that the outer periphery and front face of the connector housing 20 are covered with the peripheral wall 41 and the end wall 42 of the waterproof sealer 40, and the flange 21 of the female connector F is covered with the flange cover 43. Then, as shown in FIG. 3, the first waterproof seal 48 is set on the rear side of the female connector housing 20, and at the same time, the opening 46 is made to agree with the male connector engaging section 25 of the female connector F, and the second waterproof seal 47 in the periphery of the opening 46 is engaged along the inner peripheral face of the male connector engaging section 25.

Next, the female connector F covered with the waterproof sealer 40 denotes set in the casing 60. Then, the screw 50 having a flange is successively inserted into the through hole 44 of the waterproof sealer 40 and the through hole 22 of the female connector housing 20 and screwed into the casing 60, so that the female connector F is fixed to the casing 60. In this casing, the first waterproof seal 48 of the waterproof sealer 40 denotes interposed between the attaching end face 61 of the casing 60 and the female connector housing 20. Therefore, a gap formed between the casing 60 and the female connector housing 20 denotes sealed. When the flange 51 of the screw 50 having a flange comes into pressure contact with the seal ring 45 in the periphery of the waterproof sealer 40, the through hole 44 is sealed.

Next, the male connector M is engaged with the engaging section 25 of the female connector F. Due to the foregoing, the second waterproof seal 47 formed in the waterproof sealer 40 is arranged on the inner peripheral wall of the engaging section 25 of the female connector housing 20. Therefore, the engaging face of the female connector F and that of the male connector M are sealed.

Due to the above arrangement, each gap formed among the components from the casing 60 to the male connector M can be sealed by a single waterproof sealer 40. Therefore, the number of sealing parts can be decreased and the manufacturing cost can be reduced.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A waterproof structure comprising:

a casing body;

a first connector fitted with the casing body from a first direction;

at least one second connector housing fitted with the first connector housing from the first direction;

an interposed member placed between the first connector housing and the second connector housing;

a first seal formed on the interposed member so as to be interposed between the casing body and the first connector housing;

a second seal formed on the interposed member so as to be interposed between the first connector housing and the second connector housing, the second seal being formed integrally with the first seal a sealing member on which a first seal and a second seal are integrally formed;

a first connector housing fitted with the casing body while interposing the first seal therebetween; and a second connector housing fitted with the first connector housing while interposing the second seal therebetween.

2. The waterproof structure as set forth in claim 1, wherein the first connector is provided with a plurality of chambers;

wherein said waterproof structure includes a plurality of second connector housings which are accommodated in said plurality of chambers; and wherein the second seal is formed into a shape corresponding to the number of the second connector housings.

3. The waterproof structure as set forth in claim 1, wherein the interposed member is provided with a cover portion for covering the first connector housing and an opening into which the second connector is inserted;

wherein the first seal is formed on an end of the cover portion so as to be interposed between the first connector housing and the casing body; and wherein the second seal is formed on a periphery of the openings so as to be interposed between the first and second connector housings.

4. The waterproof structure as set forth in claim 1 wherein the sealing member is provided with a through hole into which a screw is inserted to secure the first connector housing to the casing body; and wherein the screw is provided with a flange portion for sealing the through hole.

* * * * *